United States Patent [19]

Schreiber

[11] Patent Number: 4,867,354

[45] Date of Patent: Sep. 19, 1989

[54] DISPENSING CAP WITH MEANS FOR CONTROLLED FLOW RATE AND MULTIPLE SEALS

[76] Inventor: Alexander R. Schreiber, 159 Windsong St., Thousand Oaks, Calif. 91360

[21] Appl. No.: 233,825

[22] Filed: Aug. 18, 1988

[51] Int. Cl.[4] ..... B65D 47/00

[52] U.S. Cl. ..... 222/521; 222/549

[58] Field of Search ..... 222/153, 494, 519–521, 222/546, 549, 212, 499; 215/314, 354

[56] References Cited

U.S. PATENT DOCUMENTS

| | | | |
|---|---|---|---|
| 2,542,350 | 2/1951 | Paulsen | 222/499 |
| 2,673,661 | 3/1954 | Barton | 222/212 |
| 3,123,259 | 3/1964 | Musel et al. | 222/521 |
| 3,175,741 | 3/1965 | Porter | 222/521 |
| 3,216,630 | 11/1965 | Stull | 222/499 |
| 3,240,404 | 3/1966 | Porter et al. | 222/521 |
| 3,339,773 | 9/1967 | Stull | 215/329 |
| 3,406,880 | 10/1968 | Stull | 222/521 |
| 3,407,967 | 10/1968 | Stull | 222/48 |
| 4,087,023 | 5/1978 | Szczepanski | 222/209 |

*Primary Examiner*—Michael S. Huppert

[57] ABSTRACT

The invention provides a twist open/close outer cap internally threaded to fit the threads on a special bottle neck in cooperative sealing attachment with an inner cap inserted into the bottle neck. Structural features and a stop provide bi-directional controlled rotation of the outer cap. A beveled top fluid release plug fitting a correspondingly beveled dispensing aperture and interacting insert structure provides excellent sealing characteristics. The outer cap is a short cylindrical member with an opened bottom and a shallow concave top surface. A flow directing inverted funnel-like protrusion is formed around a dispensing aperture in the center of the outer cap top. Depending from the underside of the outer cap top surface, is a cylindrical sleeve fitting a receiving chamber formed by two base attached walls in the second cap inserted into the neck of the bottle. Screwing the outer cap up and down on threads cooperative with neck threads on the bottle, opens and closes the dispensing aperture by inserting and withdrawing the plug fitting the aperture. The positioning of stops on the outer bottle neck surface and the inner wall of the outer cap control the dispensing opening and are set in manufacturing according to the viscosity of the material to be dispensed.

3 Claims, 3 Drawing Sheets

DISPENSING CAP WITH MEANS FOR CONTROLLED FLOW RATE AND MULTIPLE SEALS

BACKGROUND OF THE INVENTION

1. Field of the Invention

This invention relates to bottle closures in general and more specifically to an improved twist open/close cap having a stop wedge cooperative with a stop wedge on the neck of a container for dispensing rate control and preventing removal of the outer cap. The present invention provides multiple fluid seals.

2. Description of the Prior Art

The use of twist open/close container closures are well known and have been in commercial use for some time. One basic characteristic common to all these closures is the ability to dispense the container contents without removing the outer cap. This is generally accomplished by means of cooperative threads or ramp systems designed to raise an outer cap releasing the sealing engagement between a central plug and an aperture in the outer cap. Unfortunately many of the outer caps of these closures contain no means for alerting the user when the dispensing aperture is in the full open position. Without some form of stopping means, the outer cap can be inadvertently removed negating the convenience of the twist open/close caps. Stop wedges or lugs which prevent overturning the cap upwardly or downwardly are sometimes used. Subtle differences is design, however, can create major differences in cap efficiency. These subtle design differences can also be involved in the cost effectiveness of the manufacturing process as well as causing major changes in the convenience of use and ability of the cap to seal well.

To uncover past art pertaining to twist open/close caps utilizing step means designed to limit rotation of the outer cap and prevent removal or disassembly of the cap components, a search was conducted in the following classes and subclasses:

222/521, 542, 521, and 494.

Although a wide variety of past art twist open/close caps were produced by the search, none provided a combination of stop blocks (and method) and multiple sealing in the same manner my cap does.

Those patents which seemed to describe caps having mechanics most representative to my device included:

U.S. Pat. No. 2,542,350, granted to E. H. Paulsen on Feb. 20, 1951, for snap-on dispensing closure for collapsible tubes having a positioning lug for limiting the revolution of the outer cap when opening the dispensing cap. To snap the Paulsen cap onto the tube neck threads, it was necessary to provide the lower portion of the cap skirt with longitudinal slits to gain resilience for permitting the cap to be snapped in place over the threads of the tube neck. Slitting the cap weakens the cap structure as well as provides a bacterial entrance into the tube neck. With modern plastic materials available for manufacturing today, the slits in the cap skirt would add needless cost to the tooling and manufacturing of a similar cap. Also, the central closure plug structure is inherent to the tube or container making the cap incompatible with typical bottle blow mold manufacturing. That particular container manufactured as a tube would normally not have a flat supporting bottom surface. This proves to limit the use of this closure to dispensing the more viscous types of materials such as toothpaste due to the fact that the container will more that likely be positioned on the side, resulting in increased incidence of leakage of a more fluid material.

The Porter patent, U.S. Pat. No. 3,175,741, dated Mar. 30, 1965, describes a "Closure And Dispensing Cap For The Neck Of a Container." A stop for limiting rotation of the outer cap utilizing wedge shaped vertical stops are used to limit the revolution of the outer cap to about one 360 degree rotation. Removal of the outer cap is prevented by the abutment of the wedge shaped stops when in the full opened position. The outer cap is structured with a considerably concaved circular top portion having a dispensing hole in the bottom of the concave surface area, a structure allowing for a short turn to place the plug securely in the outer cap aperture. This cap would have a limited use as directive dispensing of materials from the container would appear difficult. Deeply concaved dispensing tops have been shown to be ineffective in directing the flow of the materials accurately and usually leave a large puddle of the material in the concave dish. Also, the inner or base portion of the cap having the closure tip is intrinsic with the container making it incompatible with standard modern plastic bottle blow molding processes which require an open bottle neck.

The Stull patent, U.S. Pat. No. 3,216,630, shows a narrow tipped cap using two ramp style stop blocks to limit cap turning. These stop blocks function to limit rotation of the outer cap past the fully closed position, thereby preventing disengagement or overriding of the cooperating threads of the two cap sections. Stop blocks positioned for limiting the turning of the outer cap in the closing operation have been found to not to be an advantage. The sealing surfaces of the inner and outer cap structure must meet together with a degree of force in order to seal properly. This meeting of the sealing surfaces is marked by a noticeable increase in the resistance to turning. A user of a similar cap without stop blocks to restrict turning of the outer cap in the closing operation would be very unlikely to strip or cause the threads to override and would have a greater choice in the degree of tightness of the mating sealing surfaces. Stop blocks sometimes prevent adequate cap sealing which can cause leaking problems particularly undesirable during shipping.

Other patents issued to M. B. Stull include U.S. Pat. No. 3,339,773, dated Sept. 5, 1967; U.S. Pat. No. 3,406,880, dated Oct. 22, 1968: and U.S. Pat. No. 3,407,967, dated Oct. 29, 1968. All show variations in twist open/close caps with close sensors and limiting stops. These other Stull patents mostly illustrate caps using narrow projecting nozzles which require special packaging, are not readily stackable, have limited aperture sizing, and appear to seal only by cap contact with the container neck threads.

My invention overcomes the disadvantages seen in the past art patents by providing a more positive unrestricted sealing of the flow plug. Also, by carefully positioning cap rotational stop wedges in manufacturing, my invention provides the user virtual foolproof means to readily open the dispensing aperture to a predetermined size for a controlled optimal flow rate for the specific viscosity of material to be dispensed.

SUMMARY OF THE INVENTION

In practicing my invention I have developed a simple interlocking twist open/close outer cap fitting a threaded bottle neck in cooperative attachment with an inner cap inserted into the bottle neck. Structural features and a stop provide for bi-directional controlling the degree of rotation of the outer cap. A beveled top fluid release plug fitting a correspondingly beveled cap dispensing aperture and specially fitted insert structure provides excellent sealing characteristics. The outer cap is a short cylindrical member with an opened bottom and a shallow concave top surface. The middle of the top surface has a protruding flow directing inverted funnel-like structure formed around the dispensing aperture. Depending from the underside of the outer cap top surface is a cylindrical sleeve having an interior annular sealing ring located adjacent the lower distal end. The cylindrical sleeve is positioned concentrically under the dispensing aperture. The outer cap on the interior surface of the outer wall has threads sized and positioned for cooperative engagement with the exterior threads of the plastic bottle neck. Affixed to the outer cap on the lower interior rim of the outer wall below the threads is a wedged shaped cap stop. A second smaller inner cap member is sized for insertion into the neck of the bottle to fit tightly forming a seal and functions cooperatively with the outer cap. The inner cap is a two walled cylindrical module having a median opening through which is suspended centrally the aperture plug. The central plug is supported by three braces attached to the shorter interior wall of the inner cap. The two walls form a closed bottomed interior channel sized to receive the cylindrical sleeve of the outer cap. The upper edge of the outer wall is structured with a short horizontal flange which helps to support and seal the inner cap within the neck of the bottle or any container having a similar neck. This horizontal flange rests in a annular ledge located at the top interior rim of the bottle. As the inner cap is inserted into the neck, an annular groove located on the exterior outer wall surface of the inner cap snaps over an annular ring located on the interior bottle neck wall. These rings plus pressure applied to the inner cap outer wall against the inner wall of the container neck by insertion of the outer cap cylindrical sleeve provides an exceptionally tight liquid sealing means. The flush top seating and the snap ring fitting also prevents unintentional removal of the inner cap from the bottle.

For assembly, the outer cap with the opened bottom downwardly is centered over the inner cap installed in the bottle, and lowered. The outer cap is then turned clockwise engaging the neck threads and screwed down onto the neck of the bottle until the wedge shaped neck cap stop meets resistance from a wedge shaped neck cap stop located on the lower neck of the bottle. Continued turning forces the sloped side of the wedge shaped cap stop past the sloped side of the wedge shaped neck cap stop on the bottle neck. Pliability in the outer cap material below the thread line allows the cap will to stretch sufficiently to allow passing of the two stops. Once the stops are immediately past each other, the outer cap is free to rotate further clockwise, but will not rotate counterclockwise due to the abutment of one flat surface on each wedge against each other. Abutment of the inner surface of the top of the outer cap with the top surface of the flange of the inner cap prevents skipping of threads when the cap is over rotated in the closed position. When the cap is closed the pressure created between the horizontal flange of the inner cap and the annular ledge at the top of the bottle neck produces a tighter seal. To open the dispensing aperture, the outer cap is raised by a counterclockwise rotation which frees the plug from blocking the dispensing aperture. Over rotation which might remove the outer is prevented by the flat end of the wedged shaped cap stop contacting the flat end of the wedge shaped neck stop. The spacing of the stop wedges of my cap when the aperture is fully opened produces a factory set dispersement aperture opening which provides the optimal flow desired for the specified viscosity of a particular fluid to be dispensed. No stop wedges or blocks are required for reverse turning of my cap to seal the plug in the outer cap aperture. Upper contact between the outer cap top inner surface and the inner cap top edges, the tightening of the plug in the beveled dispensing aperture, and the pressure of the internal fittings of the outer and inner caps provide sufficient breakage to prevent over downward turning of the outer cap. With this type of cap stoppage, the lower edge of the outer cap does not come in contact with the upper surface of the bottle.

Therefore, it is a primary object of my invention to provide a cap closure with means for limiting the flow rate of a specific material to be dispensed with the same means preventing accidental removal of the outer cap.

Another object of my invention is to provide a twist open/close cap which provides a compact inner cap designed for flush top insertion into the neck of a bottle.

A further object of my invention is to provide a twist open/close cap using sealing structure and special grooving in the bottle neck to produce a firm and uniquely effective sealer.

A further object of my invention is to provide a twist open/close cap requiring no stop wedge to prevent overturning when tightening the cap to the container neck.

An even further object of my invention is to provide a twist open/close cap which is simple and cost effective to manufacture, transport, and store.

A still further object of my invention is to provide a twist open/close cap which limits the size of the opening of the dispensing aperture, and thereby the rate and amount of contents dispensed, in a manner which allows the dispensing aperture limits to be easily change in the cap manufacturing process.

Other objects and advantages of my invention will prove evident with a reading of the following specification and comparison of the numbered parts with correspondingly numbered parts included in the drawings.

DRAWING REFERENCE NUMBERS

Figure 1:
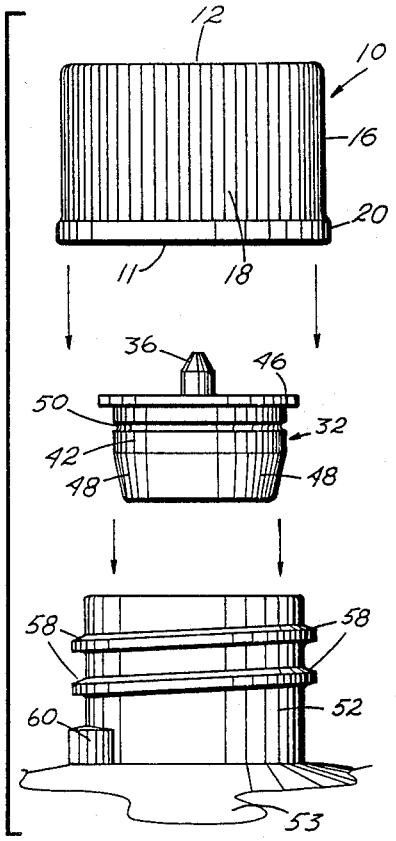
FIG. 1 is a side view of the component parts of the cap with the outer cap shown positioned above the inner cap. Both are show above the neck of the bottle.

10 outer cap
11 opened outer cap bottom
12 concave top
14 dispensing aperture
15 protruding aperture rim
16 exterior outer cap wall
17 interior outer cap wall
18 gnarled grip surface
20 outer cap annular collar
22 internal sealer sleeve
24 sealer ring
26 beveled aperture edge
28 internal threads
30 wedged cap stop
32 inner cap
34 inner cap flow channel
36 plug
38 plug support brackets
40 plug support wall
42 inner cap outer wall
43 horizontal base
44 sealer intrusion chamber
46 inner cap support flange
48 beveled insertion rim
50 inner cap sealer groove
52 bottle neck
53 bottle
54 inner cap support ledge
56 inner cap support ring
58 exterior bottle threads
60 wedge shaped neck cap stop
62 base end

DESCRIPTION OF THE PREFERRED EMBODIMENT

Figure 9:
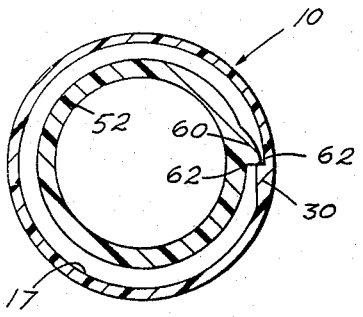
FIG. 9 is a cross section top plan view of the assembled cap illustrating the position of the stop wedges when the cap is in the opened or dispensing position.
Figure 10:
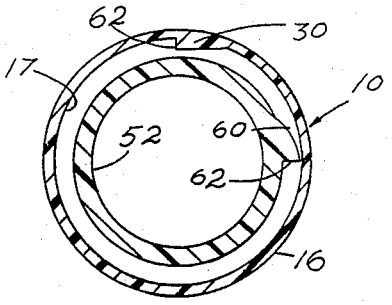
FIG. 10 is a cross section top plan view of the assembled cap illustrating the position of the stop wedges when the cap is in the closed position.
Figure 11:
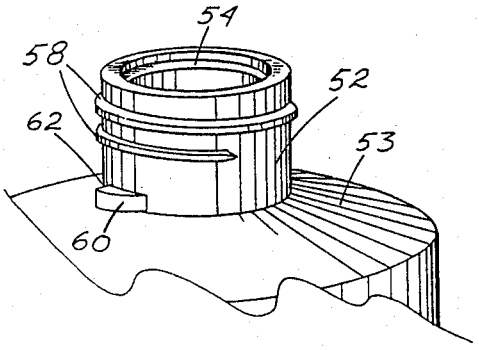
FIG. 11 is a perspective view of the bottle neck illustrating the inner cap support ledge, neck threading, and wedge shaped neck cap stop.
Figure 12:
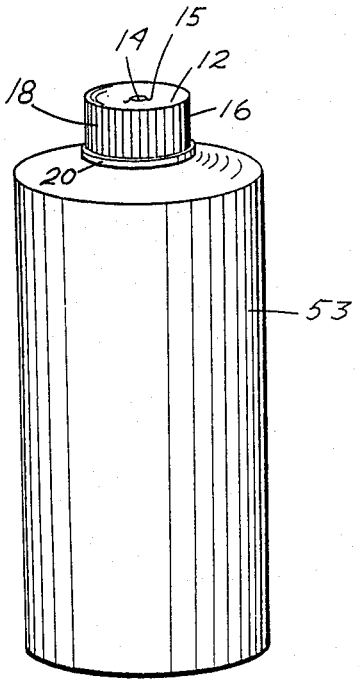
FIG. 12 is a perspective view of the cap assembled onto the neck of the dispensing bottle.

Referring now to the drawings and to FIG. 1 where the preferred embodiment of the invention is illustrated in an unassembled view. Outer cap 10 is a short cylindrical member having an opened outer cap bottom 11 downwardly and a shallow concave top 12 upwardly. The outer exposed curved vertical wall surface of outer cap 10, exterior cap wall 16, is textured with gnarled grip surace 18 down to a lower untextured rim designated outer cap annular collar 28. Dispensing aperture 14 is centrally positioned in concave top 12. Protruding aperture rim 15 extends upwards above the surface of concave top 12 and forms a narrow inverted funnel-like flow directing lip concentrically positioned around dispensing aperture 14. Dispensing aperture 14 is formed by downwardly outwardly beveled aperture edge 26, a curved wall extending through the surface of concave top 12. Suspended downwardly from the underside of concave top 12 in the interior of outer cap 10 is internal sealer sleeve 22, a second smaller vertically oriented cylindrical wall best seen in FIG. 2. Internal sealer sleeve 22 is positioned concentric and outwardly of beveled aperture edge 26. Seated at the internal lower distal end of internal sealer sleeve 22 is a horizontal annular ring designated sealer ring 24. The interior surface of outer cap 10, interior cap wall 17, is affixed upwardly with internal threads 28 from the underside of concave top 12 extending downwardly terminating above an unthreaded rim section affixed with an inwardly projecting wedge shaped cap stop 30. Wedged shaped cap stop 30 has a vertical base end 62 with a flat bottom surface, an upwardly angled top surface and a curved vertical side wall, shown in FIGS. 2, 9, and 10.

Inner cap 32, shown in FIGS. 1, 2, 3, 4, and 8 is a cylindrical insert formed of two vertically inclined side walls spaced one inside the other. The two walls of inner cap 32 are designated plug support wall 40 and outer wall 42. In the center of plug support wall 40 is an opening designated inner cap flow channel 34. Suspended vertically in the center of inner cap flow channel 34, extending upward above the uppermost edge of both plug support wall 40 and outer wall 42 is cylindrical plug 36. Plug 36 is smaller in external diameter than that of the internal diameter of cap flow channel 34 to allow fluid flow around lug 36. Cylindrical plug 36 is supported by three horizontal plug support brackets 38 properly sized to maintain the open channel of cap flow channel 34 best seen in FIG. 2. The upper distal end of plug 36 bevels upwardly and inwardly to sealably match to beveled aperture edge 26 when the cap is in the closed position. The shorter interior wall of inner cap 32, plug support wall 40, supports plug 36 by way of plug support brackets 38 affixed to the upper rim of wall 40. Inner cap outer wall 42 forms the outer eall of inner cap 32. Outer wall 42 has a lower section angled inwardly then turned inward to from horizontal base 43. Plug support wall 40 is attached to the inner edge of the horizontal base 43 shown best in FIG. 2. A narrow upwardly opened tubular chamber which is formed between the two walls is designated sealer intrusion chamber 44. Sealer intrusion chamber 44 is sized to sealably and releasably receive internal sealer sleeve 22, shown in FIG. 8. The upper edge of inner cap outer wall 42 is affixed with a narrow outward extending horizontal member, inner cap support flange 46, which serves as a supporting and sealing surface. Upwardly, the exterior wall surface of inner cap outer wall 42 is chased with annular inner cap sealer groove 50 which also serves as a support and sealing surface, shown in FIG. 1. The downwardly and inwardly beveled lower section of inner cap outer wall 42 designated rim 48 is designed to ease interdiction of inner cap 32 into the interior of bottle neck 52. Bottle neck 52 is externally threaded and sized for cooperative juncture with outer cap 10, and internally sized to sealably receive inner cap 32. The upper edge of bottle neck 52 has an inner annular ledge designated inner cap support ledge 54, best seen in FIG. 2. Inner cap support ledge 54 is sized to receive inner cap support flange 46 so the upper outer edge of inner cap 32 is flush with the upper edge of bottle neck 52. In the interior of bottle neck 52 a short distance below inner cap support ledge 54 is an interfaced inner cap support ring 56 positioned to snap fit into inner cap sealer groove 50. Inner cap support ring 56 can be the manufacturer's blow ring, a ring normally remaining in the neck of a plastic bottle from the blow molding manufacturing procedure of bottle 53, or an internal annular ring added for sealably mating with inner cap sealer groove 50. The outer wall surface of bottle neck 52 is finished with exterior bottle threads 58 which correlate with internal threads 28 of outer cap 10. The base of bottle neck 52, where attachment is made to bottle 53, is affixed with wedge shaped neck cap stop 60 on the side of bottle neck 52, below the downward terminal end of threads 58 as shown in FIGS. 1, 2, 7, and 11. Wedge shaped neck cap stop 60 is formed in the shape of a vertical wedge having a rounded side wall with a flat top surface and a flat vertical base end 62. The rounded side wall of wedge shaped neck cap stop 60 curves back and terminates against the outer wall of bottle neck 52 while the bottom surface is attached to the top surface of bottle 53. A flat vertical end, base end 62, is common to both wedge shaped cap stop 30 and wedge shaped neck cap stop 60.

Figure 2:
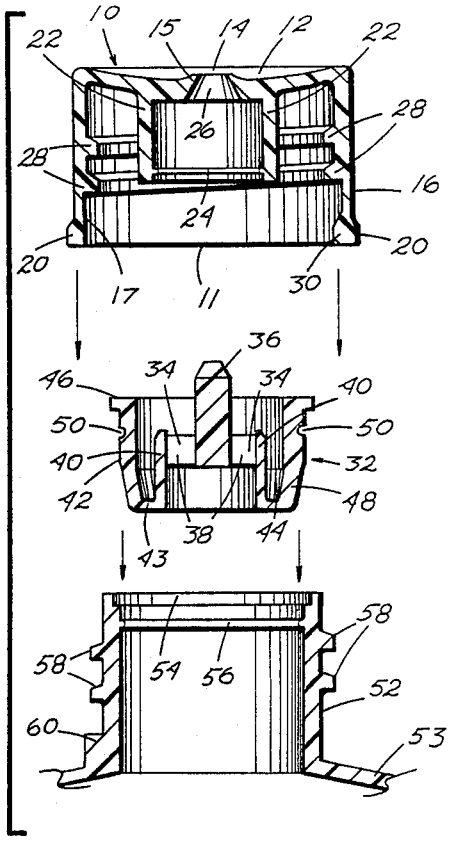
FIG. 2 is a sectional side view of the component parts of the cap with the outer cap shown positioned above the inner cap. Both are shown above the neck of the bottle.
Figure 3:
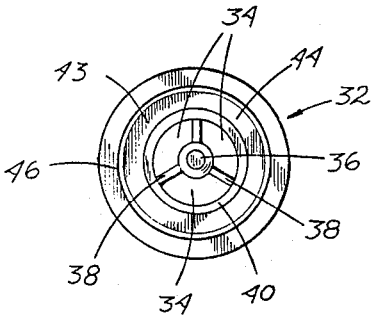
FIG. 3 is a top view of the inner cap.
Figure 4:
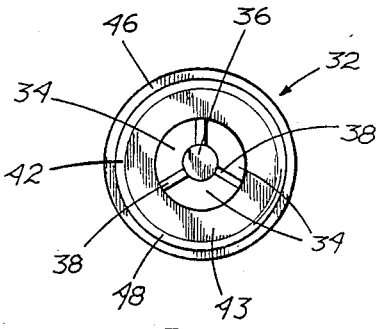
FIG. 4 is a bottom view of the inner cap.
Figure 5:
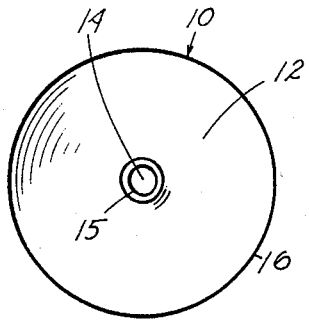
FIG. 5 is a top view of the outer cap.
Figure 6:
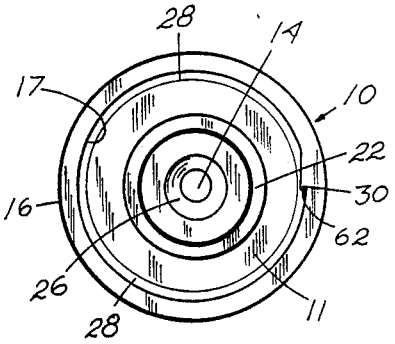
FIG. 6 is a bottom view of the outer cap.
Figure 7:
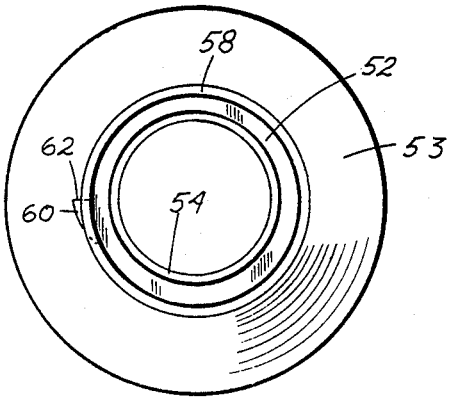
FIG. 7 is a top view of the bottle with attached threaded neck.
Figure 8:
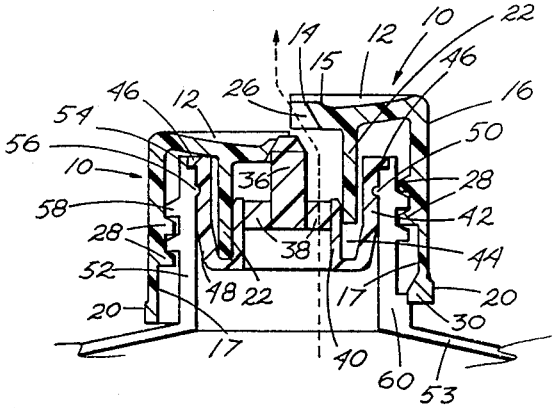
FIG. 8 is a sectioned side view of the assembled cap, wherein the left side of the drawing represents the cap in the closed position, and the right side shows the open position.

For assembly, inner cap 32 is positioned over bottle neck 52, as seen in FIGS. 1 and 2, and inserted forming a flush seal at the top and between the walls of inner cap 32 and bottle neck 52, as shown in FIG. 8. Further support and sealing means are provided with the connection of inner cap sealer groove 50 over protruding inner cap support ring 56, as well as inner cap support flange 46 onto inner cap support ledge 54, shown in FIG. 8. Outer cap 18 is positioned with opened outer cap bottom 11 downwardly over inserted inner cap 32 and bottle neck 52, shown in FIGS. 1 and 2. Dispensing aperture 14 is aligned with plug 36, and internal sealer sleeve 22 is aligned with sealer intrusion chamber 44. Outer cap 10 is lowered until internal threads 28 contact exterior bottle threads 58. Outer cap 10 is then rotated clockwise on the correlating threads. As outer cap 10 is further rotated clockwise, downwardly, the apex edge of wedged shaped cap stop 30 comes into contact with the apex edge of wedge shape neck cap stop 60. Outer cap 10 is then formed further and the flexible resilient material below the downward terminal and of internal threads 28 bends outward allowing wedge shape cap stop 30 past wedge shaped neck cap stop 60 where outer cap 10 is then movably retained, allowing outer cap 10 to further advance downwardly into the closed position. As outer cap 10 is rotated clockwise, downwardly, internal sealer sleeve 22 is inserted into sealer intrusion chamber 44 with sealer ring 24 contacting the exterior side of plug support wall 40, creating a tight but movable seal. The interior wall surface of beveled insertion rim 48 serves to force the lower distal end of internal sealer sleeve 22 with greater pressure into plug support wall 40. The interior space between inner cap outer wall 42 and plug support wall 40 at the bottom of sealer intrusion chamber 44 is less than that of the wall thickness of internal sealer sleeve 22. The forcing of internal sealer sleeve 22 into the bottom of sealer intrusion chamber 44 causes increased pressure and sealing between sealer ring 24 and plug support wall 40, while at the same time creating greater pressure between inner cap outer wall 42 and the interior surface of bottle neck 52.

When outer cap 10 is rotated counterclockwise, it is elevated releasing the sealing engagement between dispensing aperture 14 and plug 36. The contents of bottle 53 can then flow through inner cap flow channel around plug 36 and plug support brackets 38 out through the opened dispensing aperture 14. The straight base end 62 of wedge shaped cap stop 30 abuts with the base end 62 of wedge shaped neck cap stop 60, preventing further counterclockwise rotation or removal of outer cap 10. For sealing, outer cap 10 is rotated fully clockwise resulting in plug 36 being reinserted into dispensing aperture 14. The underside of concave top 12 abuts and applies pressure to inner cap support flange 46 forcing it tightly into inner cap support ledge 54. Internal sealer sleeve 22 enters the narrowed bottom of sealer intrusion chamber where it is forced tighter into plug support wall 40 also forcing inner cap outer wall 42 tighter against the interior wall of bottle neck 52. It is the combination of the resistance of these forces which supply sufficient braking to outer cap 10 to prohibit overriding of the treads.

In my cap design, by reducing the size of inner cap 32 and inserting it into the bottle neck 52 of bottle 53, outer cap 10 can also be reduced in size. A thin flexible plastic structure is used requiring less material during manufacture and less space during shipping and storage. The combination of inner cap 32, inner cap support flange 46, and inner cap support ring 56 provides an efficient tight seal especially when internal sealer sleeve 22 is inserted into sealer intrusion chamber 44. This multiple sealing structure effectively prevents leaks and loss of container content particularly if a rough ride occurs during shipping.

When the cap is in the full opened position, determined by the positioning of the stop wedges, the user is provided with a dispensing aperture size predetermined for a controlled optimal flow rate for the specific viscosity of material to be dispersed for bottle 53. In manufacturing the cap, dispensing aperture 14 is sized large enough for proper dispensing of very viscous fluids. If a less viscous material is to be used, wedge shaped cap stop 30 is repositioned in outer cap 10 in a manner which allow less counterclockwise turning from fully closed to where cap stop 30 abuts neck cap stop 60. This allow outer cap 10 to rise less, separating plug 36 only a small amount from dispensing aperture 14 effecting reducing the flow rate. The positioning of wedge shaped cap stop 30 at the bottom open end of outer cap 10 allows the plastic injection molds used to make my cap to be structured in a well know manner to provide flexibility in the positioning of wedge shaped cap stop 30 without major tooling cost. By molding wedge shaped cap stop 30 onto outer cap 10 with a separate mold core, wedge shaped cap stop 38 can be positioned anywhere around a 360 degree radius by simply rotating the mold core to the desired position relative to the fully closed position of the cap.

Although I have described my invention in detail in the foregoing specification, it is to be understood that modifications in the structure and design of the cap can be practiced which do not exceed the intended scope of the appended claims.

What I claim is:

1. A multiple sealing dispenser cap with means for controlling dispensing flow rate, comprising:

a. an outer cap member;

said outer cap member being cylindrically formed with a vertically oriented side wall, downwardly with an opened bottom, upwardly with a shallow concave top surface; said vertically oriented side wall, the outer surface thereof, gnarled from said top surface, the edge thereof, downwardly to a narrow annular rim edging said downwardly opened bottom, the interior surface of said vertically oriented side wall having threading from the underside of said outer cap top surface downwardly terminating above the lower interior edge of said vertically oriented side wall; said outer cap affixed on said lower interior edge of said vertically oriented side wall below said terminal end of said threading with a wedged shaped cap stop; said shallow concave top surface of said outer cap member having centrally a protruding inverted funnel-like structure concentric to a dispensing aperture positioned centrally above a downwardly outwardly beveled side wall forming said dispensing aperture through said top surface of said outer cap; depending from said underside of said outer cap top surface outwardly and concentrically of said beveled side wall forming said dispensing aperture is a vertically oriented cylindrical sleeve having an interior annular sealing ring adjacent the lower distal end of said cylindrical sleeve;

b. an inner cap member;

said inner cap member cylindrically formed of two vertically inclined side walls spaced one inside the other with the outermost wall having a lower section angled inwardly then turned inward to form a horizontal base; the innermost wall being of less length than said outermost wall and attached downwardly to said outermost wall at the inside edge of said horizontal base with said space between said walls opened upwardly, said attachment of said double side walls forming a closed bottomed intrusion sealing chamber sized to sealably receive said cylindrical sleeve of said outer cap member, said innermost wall providing a tubular passageway centrally through said inner cap member in which is suspended a cylindrical vertically inclined central plug of lessor external diameter than the internal diameter of said tubular passage wherein said central plug extends upwardly above the upper most edge of both said spaced walls supported by brackets attached to the interior surface of said innermost wall with said brackets of sufficient size to maintain an open passageway between said innermost wall and said plug; said plug, the upper tip end thereof, upwardly inwardly beveled to sealably match said downwardly outwardly beveled side wall forming said dispensing aperture through said top surface of said outer cap member; said inner cap member having the upper edge of said outermost wall flanged horizontally; and an annular groove in said exterior surface of said outermost wall sized to fit snapped over a protruding annular ring on the interfaced surface of c. a bottle neck;

said bottle neck externally threaded and sized for cooperative juncture with said outer cap member and said inner cap member with said bottle neck being sized to sealably receive said inner cap member internally, there being an annular ledge at the uppermost inside edge of said bottle neck sized therefore supporting and sealing said inner cap horizontally flanged upper edge of said outermost wall in flush alignment with said uppermost edge of said bottle neck; said bottle neck having a wedge shaped neck cap stop attached to the exterior surface of said bottle neck below the downwardly terminal end of said external threads; said bottle neck having said interface protruding annular ring size and positioned inside for said snapped over fitting of said annular groove in said exterior surface of said outermost wall of said inner cap member forming a seal therebetween; said bottle neck affixed to a plastic dispensing bottle.

2. The device of claim 1 wherein said means for controlling dispensing flow rate includes said wedge shape cap stop affixed downwardly on said inner wall surface of said outer cap is cooperation with said wedge shape cap stop affixed downwardly on said outer surface of said bottle neck with said wedge shape cap stop prepositioned to allow said outer cap a measured amount of turning for said dispensing aperture to be opened to requirements for a desired dispensing flow according to the viscosity of materials to be dispensed.

3. The device of claim 1 wherein said outer cap member and said inner cap member are manufactured of a light weight pliable plastic material.

* * * * *